US007683278B2

(12) United States Patent
Kakita et al.

(10) Patent No.: US 7,683,278 B2
(45) Date of Patent: Mar. 23, 2010

(54) PUSHBUTTON SWITCH MOUNTING STRUCTURE

(75) Inventors: Kousuke Kakita, Yokohama (JP); Takahisa Kitahara, Isesaki (JP)

(73) Assignees: Alpha Corporation, Kanagawa (JP); Tokyo Parts Industrial Co., Ltd., Gunma-Ken (JP)

( * ) Notice: Subject to any disclaimer, the term of this patent is extended or adjusted under 35 U.S.C. 154(b) by 0 days.

(21) Appl. No.: 12/253,492

(22) Filed: Oct. 17, 2008

(65) Prior Publication Data

US 2009/0101485 A1 Apr. 23, 2009

(30) Foreign Application Priority Data

Oct. 19, 2007 (JP) ..... 2007-272922

(51) Int. Cl.
*H01H 13/06* (2006.01)

(52) U.S. Cl. ..... 200/302.2; 200/330; 200/345; 292/336.3; 292/347

(58) Field of Classification Search ..... 200/302.2, 200/520, 302.1, 329, 333, 341, 345, 330, 200/52 R; 292/348, 347, 336.3
See application file for complete search history.

(56) References Cited

U.S. PATENT DOCUMENTS 3,917,917 A * 11/1975 Murata ..... 200/517
5,510,584 A * 4/1996 Norris ..... 200/5 A
5,647,117 A 7/1997 Kurita
6,102,394 A 8/2000 Wurz et al.
6,571,457 B2 * 6/2003 Naritomi ..... 29/622
6,626,473 B1 * 9/2003 Klein et al. ..... 292/347

FOREIGN PATENT DOCUMENTS

JP 3208574 * 2/1993
JP 3208574 7/2001

* cited by examiner

*Primary Examiner*—Kyung Lee
(74) *Attorney, Agent, or Firm*—Drinker Biddle & Reath LLP

(57) ABSTRACT

A pushbutton switch is provided with: a switch case; a switch body fixed to the switch case; an elastic sealing body that is formed of an elastic material and covers and seals the switch body; a cap member that is formed of a hard material and is detachably mounted at a top portion of the elastic sealing body; a pushbutton portion provided on the cap member and exposing from a switch exposure aperture on a switch mounting apparatus; and a stopper portion provided on the cap member and configured to interfere with a rear surface of the switch mounting apparatus at a peripheral area of the switch exposure aperture and to restrain the cap member from being detached from the switch mounting apparatus, in a state in which the switch case is fixed to the switch mounting apparatus.

4 Claims, 4 Drawing Sheets

PUSHBUTTON SWITCH MOUNTING STRUCTURE

BACKGROUND OF THE INVENTION

1. Field of the Invention

The present invention relates to a pushbutton switch mounting structure.

2. Background Art

JP-B2-3208574 discloses a conventional pushbutton switch. The conventional pushbutton switch has a switch case formed by connecting upper and lower housings to each other, a switch body accommodated in the switch case, and a pushbutton that operates the switch body by performing a push-down operation. The pushbutton is mounted in the switch case to be restrained by the upper housing from being detached therefrom. To prevent water from entering a storage region in the switch body from an operating clearance of the pushbutton, a sealing rubber member is disposed in the switch case so that the peripheral edge portion of the sealing rubber member is put into between the upper and lower housings.

However, the above conventional pushbutton is preliminarily incorporated in the switch case. Thus, for example, in a case where the color specification of the pushbutton is set, it is necessary to assemble the switch case by preliminarily taking the color specification of the pushbutton into consideration. Accordingly, the conventional pushbutton switch has a drawback in lacking production flexibility.

This problem can be solved by enabling the replacement of the pushbutton by, for example, connecting the pushbutton detachably to the rubber member. However, in the case of connecting the pushbutton to the flexible rubber member, generally, high connecting strength therebetween cannot be expected. Thus, troubles, such as detachment of a currently used pushbutton, tend to occur. Although the connecting strength between the pushbutton and the rubber member can be increased by setting an engaging margin for the engagement therebetween to be fairly large, in this case, the workability of mounting the pushbutton therein is extremely deteriorated. Thus, the productivity of the pushbutton switch is reduced. In addition, the possibility of damaging the rubber member is increased. Consequently, the reliability of the sealability of the pushbutton switch is reduced.

SUMMARY OF THE INVENTION

One or more embodiments of the invention provide a pushbutton switch mounting structure capable of flexibly dealing with the variety of color specifications or the like of a pushbutton. In addition, one or more embodiments of the invention provide a pushbutton switch enabled to be used in the aforementioned mounting structure.

In accordance with one or more embodiments of the invention, a pushbutton switch 100 is provided with a switch body 4 accommodated in a switch case 8, and an elastic sealing body 5 that seals an accommodating region in which the switch body 4 is accommodated. A pushbutton portion 3 for operating the switch body 4 through the elastic sealing body 5 is formed in a hard cap member 6 that is connected to the elastic sealing body 5.

A switch exposure aperture 1 is formed in a switch mounting apparatus 2 to which the pushbutton switch 100 is mounted. The pushbutton switch 100 is fixed to the switch mounting apparatus 2 by fitting the pushbutton portion 3 into the switch exposure aperture 1 from a rear surface side of the switch mounting apparatus 2. When a force in a pull-out direction is applied to a cap member 6 in a state in which the pushbutton switch 100 is fixed to the switch mounting apparatus 2, a stopper portion 7 formed in the cap member 6 abuts a peripheral edge portion of the switch exposure aperture 1 of the rear surface side of the switch mounting apparatus 2. Thus, the stopper portion 7 is prevented from being pulled out from the switch exposure aperture 1. Consequently, the cap member 6 is restrained from being detached from the elastic sealing body 5.

In accordance with one or more embodiments of the invention, the stopper portion 7 is caused to abut the switch mounting apparatus 2 to thereby restrain the cap member 6 from being detached from the elastic sealing body 5. Thus, there is no necessity for high connecting strength between the cap member 6 and the elastic sealing body 5 of the pushbutton switch 100, even when the pushbutton switch 100 is alone. Consequently, it is enough to connect the cap member 6 to the elastic sealing body 5 with sufficient strength to temporarily hold the cap member 6 against the elastic sealing body 5. Accordingly, the replacement of the cap member 6 at assembly thereof to the switch mounting apparatus 2 according to specifications is facilitated. In addition, the elastic sealing body 5 is prevented from being accidentally scratched at the mounting of the cap member 6 in the switch mounting apparatus 2.

The aforementioned pushbutton switch 100 may be formed so that a pushed portion 5*c* is formed on a head portion of the elastic sealing body 5, and that the cap member 6 is attached on the elastic sealing body 5 to cover the head portion of the elastic sealing body 5. In the case of forming the pushbutton switch 100 in this manner, the same pushbutton switch 100 can deal with a specification in which the cap member 6 is not mounted thereon and in which the pushed portion 5*c* of the elastic sealing body 5 is exposed directly from the switch exposure aperture 1, in addition to change of the color specification or the like of the cap member 6 only by changing a method of mounting the pushbutton switch 100 in the switch mounting apparatus 2.

In the case of attaching the cap member 6 on the elastic sealing body 5, a mounting position, at which the switch case 8 is mounted, is shifted in a push-in direction, as compared with the case of exposing the pushed portion 5*c* of the elastic sealing body 5 to the outside from the switch exposure aperture 1. Accordingly, it is necessary to adjust the height of the mounting position. The adjustment of the height may be performed by, e.g., interposing a spacer between the mounting member and the switch case. However, when the pushbutton switch 100 is formed by fixing the mounting member 10 to the bottom wall of the switch case 8, the pushbutton switch 100 can deal with both specifications respectively corresponding to the cases of the presence and the absence of the cap member 6 only by changing the mounting member 10. Consequently, the commoditizing of components is achieved. In addition, the necessity for performing the mounting of the spacer in the pushbutton switch is eliminated. Accordingly, time and effort required to mount the spacer therein can be saved.

According to one or more embodiments of the invention, the pushbutton portion can easily be mounted in and detached from the switch mounting apparatus. Thus, it becomes possible to flexibly deal with the variety of color specifications or the like of a pushbutton. In addition, in a state in which the pushbutton portion is mounted in the switch mounting apparatus, the pushbutton is not recklessly detached therefrom.

Other aspects and advantages of the invention will be apparent from the following description, the drawings and the claims.

BRIEF DESCRIPTION OF THE DRAWINGS

FIG. 1A is a plan view of the embodiment. FIG. 1B is a side view of FIG. 1A. FIG. 1C is a cross-sectional view of a primary part of the embodiment.

FIG. 2A is a semi-cross-sectional view for illustrating the mounting of a cap member in a switch case. FIG. 2B is a side view of the pushbutton switch.

FIG. 3A is a plan view therefor. FIG. 3B is a view taken in the direction of arrow 3B shown in FIG. 3A.

FIG. 4A is a cross-sectional view illustrating the modification. FIG. 4B is a cross-sectional view illustrating the modification in a state in which the cap member is removed.

DETAILED DESCRIPTION OF THE EXEMPLARY EMBODIMENTS

Figure 1A:
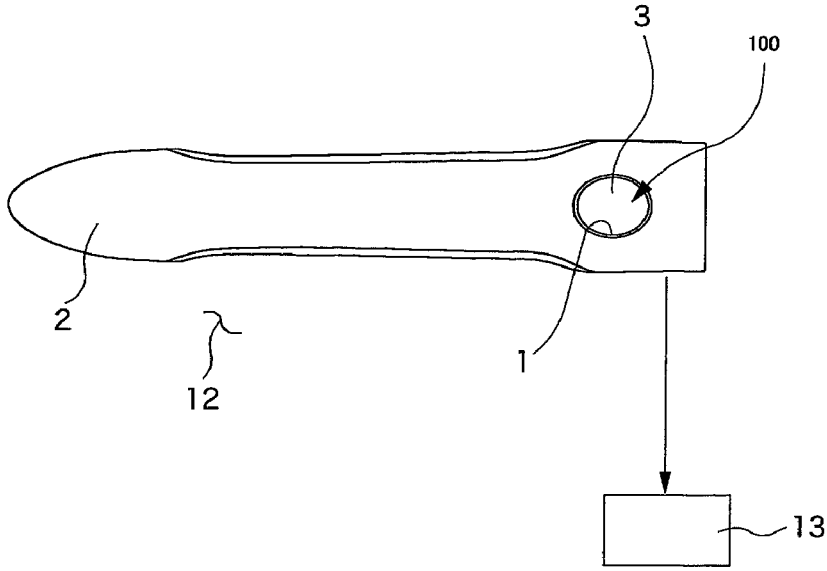
FIGS. 1A, 1B, and 1C are views illustrating an exemplary embodiment of the invention.
Figure 1B:
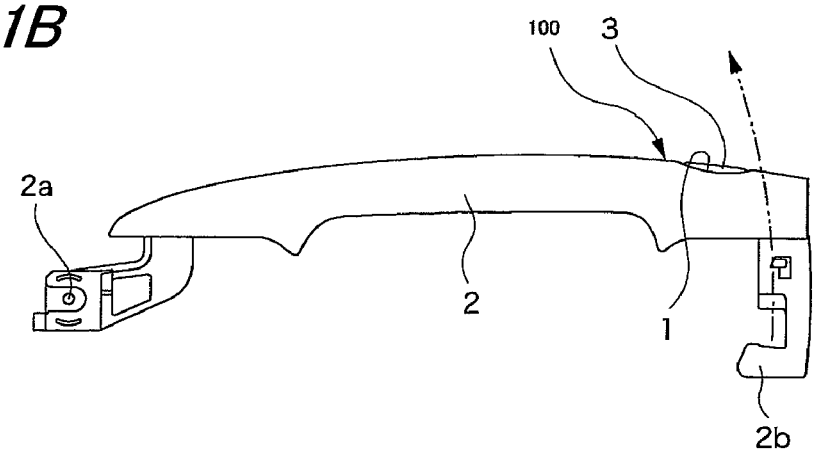
Figure 1C:
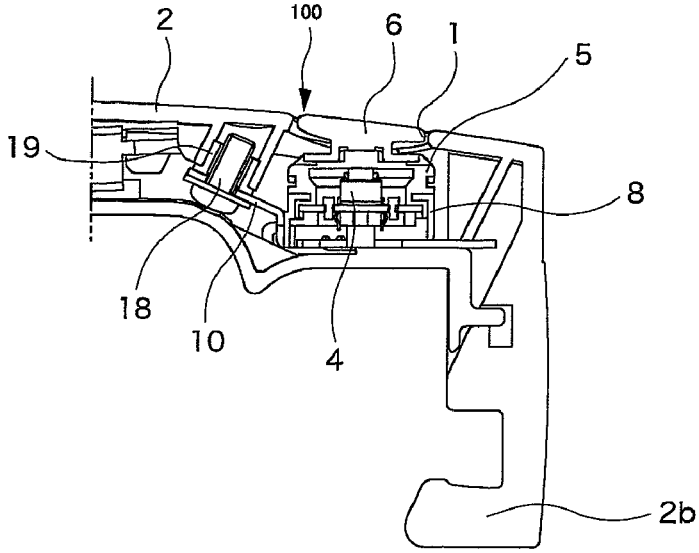

FIGS. 1A through 1C illustrate an exemplary embodiment of the invention applied to an outside handle 2 of an automobile. The outside handle 2 is mounted on a door panel 12 of an automobile to be rotatable around in a hinge 2*a*. A door latch 13 is operated utilizing the displacement of a hook portion 2*b* formed at an opposite side end, which is caused along with a rotation operation.

An operation of the door latch 13 can be locked in order to restrain an illegal door opening operation. A pushbutton switch 100 is utilized as a switch for the lock/unlock control of the door latch 13 and is incorporated into the outside handle 2. An elliptically-shaped switch exposure aperture 1, from which a pushbutton portion 3 of the pushbutton switch 100 is exposed, is opened in the outside handle 2.

Figure 2A:
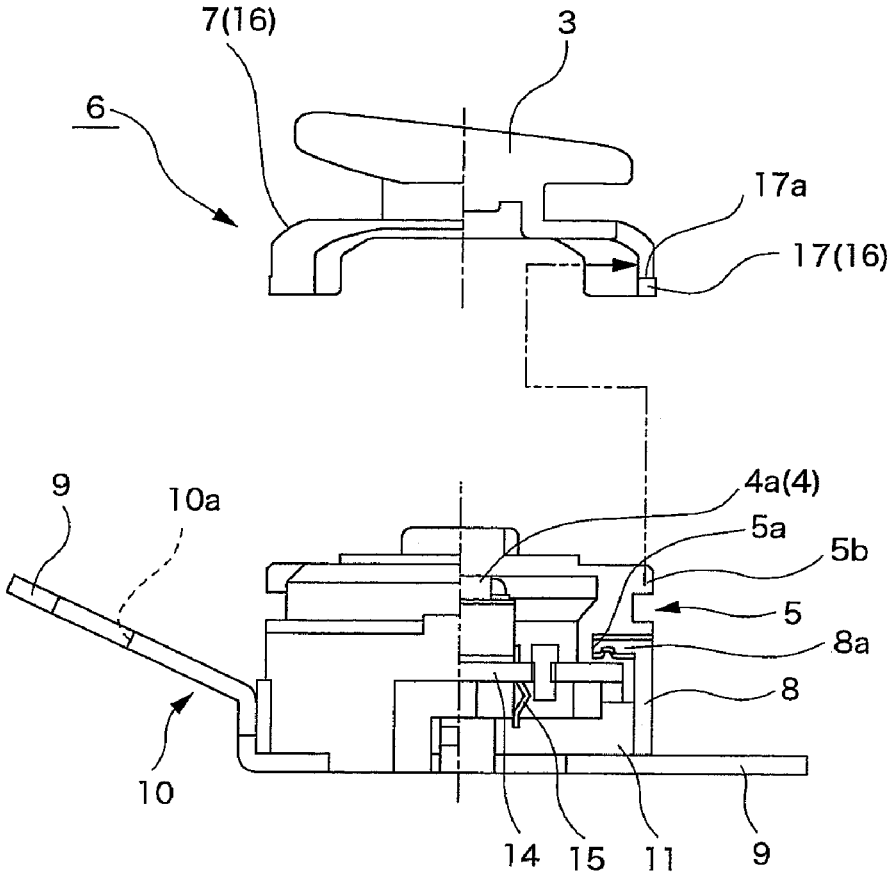
FIGS. 2A and 2B are views of a pushbutton switch.
Figure 2B:
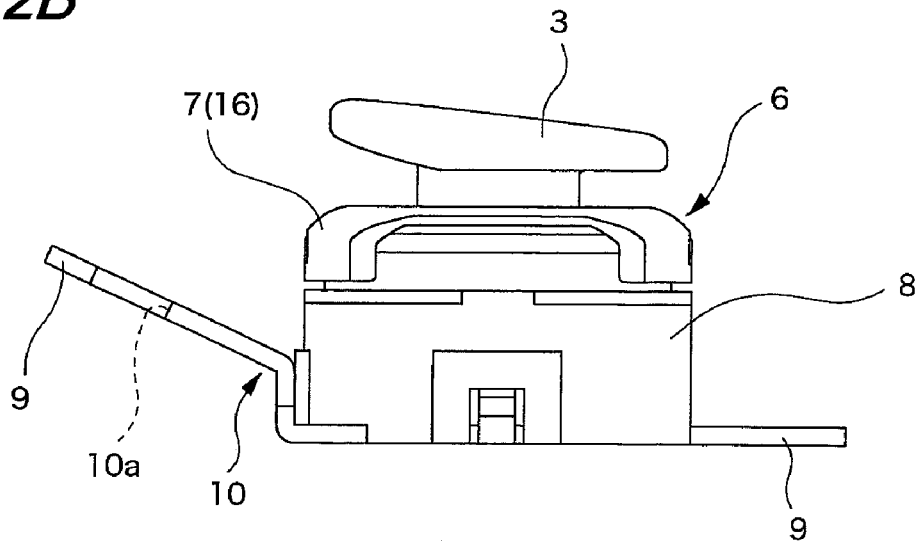

FIGS. 2A and 2B illustrate the pushbutton switch 100 in detail. The pushbutton switch 100 includes a switch case 8 formed of a synthetic resin into a cylindrical shape, and a switch body 4 accommodated in the switch case 8. In the present embodiment, a tact switch is used in the switch body 4. The pushbutton switch 100 is put into an "ON"-state by pushing an operating projection portion 4*a* there into from an initial position. On the other hand, the pushbutton switch 100 is put into an "OFF"-state by releasing a push-in operating force. The operating projection portion 4*a* is urged towards an initial position side to move the operating projection portion 4*a* to an "OFF"-position along with the release of the push-in operating force.

The switch body 4 is mounted on the printed circuit board 14 fixed in the switch case 8. An "ON"-signal and an "OFF"-signal are drawn out of the switch case 8 via a signal line (not shown) through a terminal 15 fixed to the printed circuit board 14.

In order to prevent water and dust from entering the printed circuit board 14 from a bottom portion, the printed circuit board 14 is placed in the vicinity of a top portion of the switch case 8. In addition, a lower hollow portion is filled with a sealing resin material 11.

Further, a mounting member 10 is fixed to the bottom of the switch case 8 utilizing the sealing resin material 11 as an adhesive agent. The mounting member 10 is formed of a metal plate material. The mounting member 10 has a fixing wing piece 9 extending laterally from a fixed position at which the mounting member 10 is fixed using the sealing resin material 11.

On the other hand, an inward flange 8*a* is formed over the entire circumference on the top portion of the switch case 8. The elastic sealing body 5 is mounted thereon using the inward flange 8*a*. The elastic sealing body 5 is cylindrically-shaped so that the top surface thereof is blocked up using an elastic material such as rubber. The elastic sealing body 5 is connected to the switch case 8 by fitting the inward flange 8*a* of the switch case 8 into a fitting concave portion 5*a* formed along the inner circumference of the bottom edge of the elastic sealing body.

An upward aperture of the switch case 8 is completely blocked up by mounting the elastic sealing body 5 on the switch case. Thus, water can be prevented from entering a space provided above the printed circuit board 14. A sufficient fitting margin is set between the inward flange 8*a* and the fitting concave portion 5*a* so as to exert sufficient sealability and as not to easily cause the detachment of the elastic sealing body 5 from the switch case 8.

A cap member 6 formed of a synthetic resin material is mounted on the top surface of the elastic sealing body 5. The cap member 6 is constructed by forming a connecting portion 16 integrally with a lower part of the pushbutton portion 3 having an ellipsoidal shape in plan view, which can be fit into the switch exposure aperture 1 of the outside handle 2. The connecting portion 16 has a stopper portion 7 which projects from the pushbutton portion 3 in plan view, and a pair of connecting pieces 17 which hang downwardly from the stopper portion 7. The connecting portion 16 is connected to the elastically sealing body 5 by each fitting projection portion 5*b* of the elastic sealing body 5 into an associated one of connecting openings 17*a* opened in the top end portion of each of the connecting pieces 17.

Figure 3A:
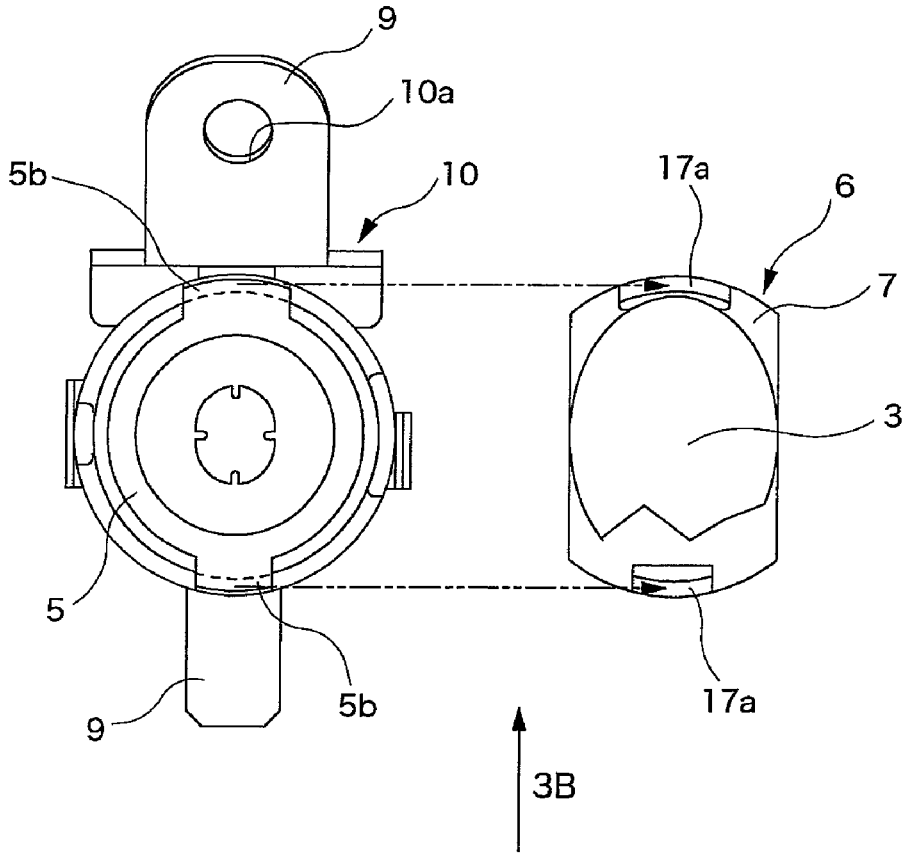
FIGS. 3A and 3B are views illustrating the mounting of the cap member in the switch case.
Figure 3B:
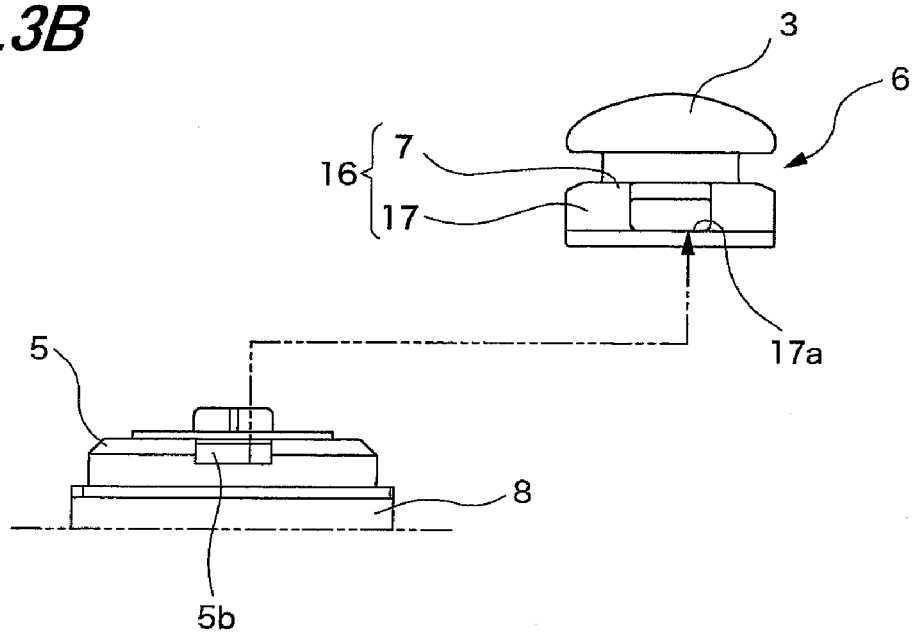

The fitting projection portion 5*b* is fit into the connecting openings 17*a* utilizing the elasticity of the elastic sealing body 5. The fitting strength between the fitting projection portions 5*b* and the connecting openings 17*a* is set at such a sufficient level as not to recklessly detach the fitting projection portion 5*b* from each of the connecting openings 17*a* at safekeeping of the pushbutton switch 100 and at transportation thereof, and as to easily achieve operations of connecting and detaching the fitting projection portions 5*b* to and from the connecting openings 17*a*. Further, as illustrated in FIG. 3A, the fitting dimensions of the fitting portions provided at two places are set at different values by considering directionality in mounting the cap member 6 in the switch case 8. Consequently, occurrence of erroneous assembly of the pushbutton switch can be prevented.

As illustrated in FIG. 2B, the ceiling rear surface of the cap member 6 in a state, in which the cap member 6 is mounted on the switch case, is contacted with the operating projection portion 4*a* of the switch body 4. When the cap member 6 is depressed, the switch body 4 operates in the "ON"-direction. When an operating force is released, the cap member 6 is returned to an initial position due to the restoring force of the switch body 4 and that of the elastic sealing body 5.

As illustrated in FIG. 1C, the pushbutton switch 100 constructed as described above is put into an "ON"-state by fitting the pushbutton portion 3 of the cap member 6 into the switch exposure aperture 1 of the mounting member 10 from the side of the rear surface of the outside handle 2. A nut 19, into which a vis 18 penetrating through a mounting hole 10*a* opened in the mounting member 10 is screwed, is fixed to the rear surface of the outside handle 2 to fix the pushbutton switch 100.

In a state in which the pushbutton switch 100 is fixed to the outside handle 2, the circumference edge of the pushbutton portion 3 is surrounded by the inner peripheral wall of the pushbutton portion 3. Thus, the cap member 6 is restrained from moving to the side. In addition, the ceiling surface of the stopper portion 7 abuts against the peripheral rear surface of the switch exposure aperture 1. Thus, the ceiling surface of the stopper portion 7 is restrained from upwardly moving, i.e., detached from the switch exposure aperture 1. Consequently, the cap member 6 is restrained from being detached from the elastic sealing body 5.

Figure 4A:
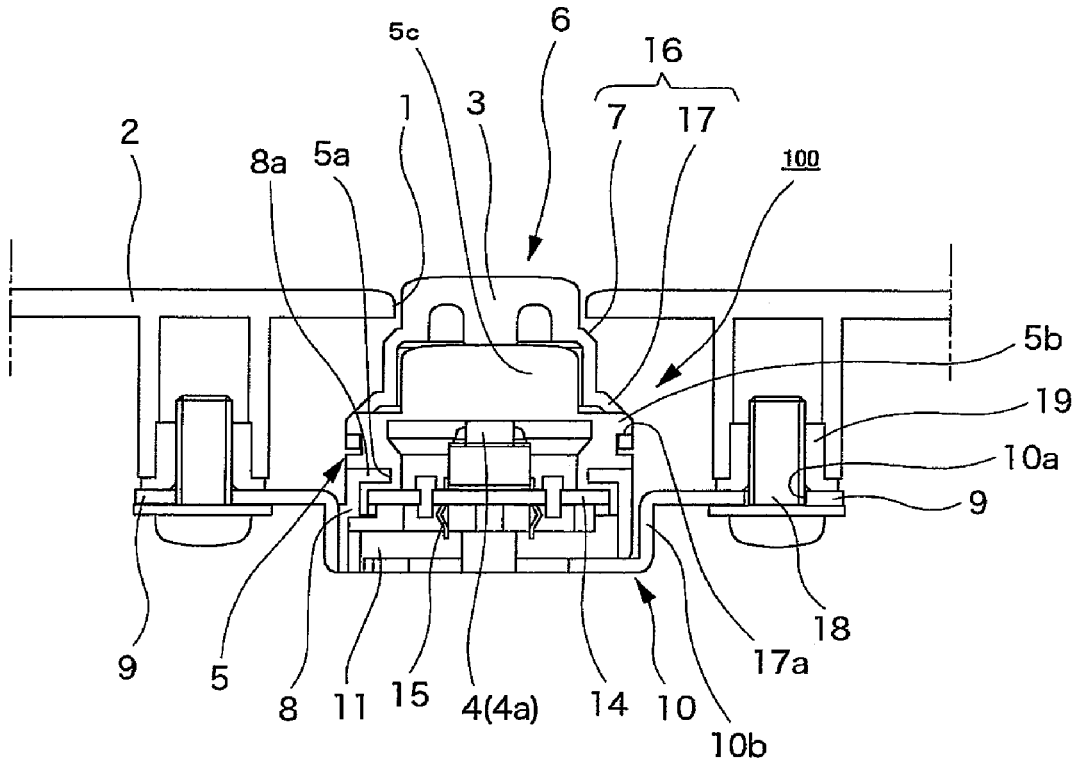
FIGS. 4A and 4B are views illustrating a modification of the embodiment according to the invention.
Figure 4B:
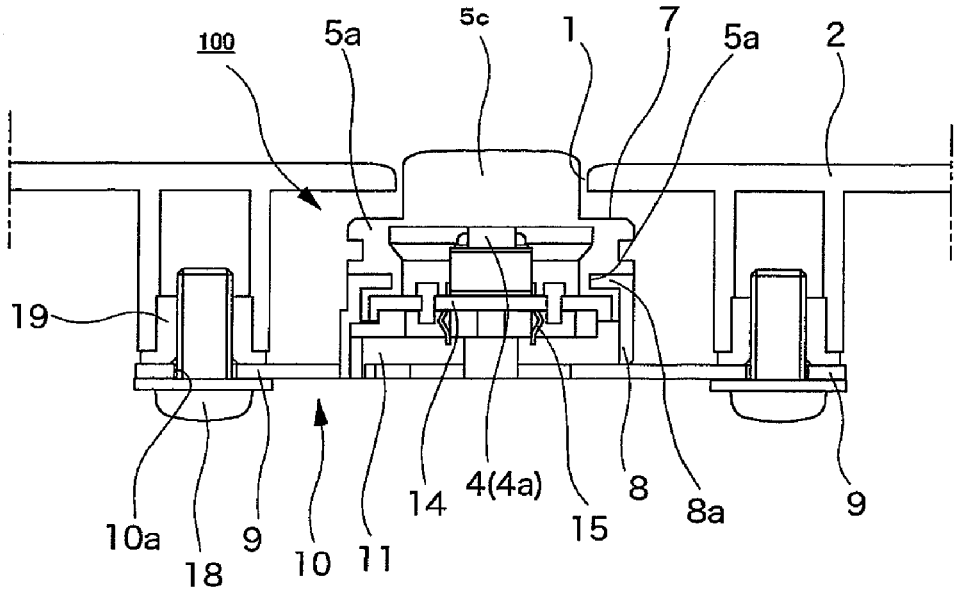

FIGS. 4A and 4B illustrate a modification of the pushbutton switch 100. Incidentally, in the description of this modification, each component which is the substantially same as an associated one of components of the aforementioned embodiment is designated with the same reference numeral used to designate such a component of the aforementioned embodiment. Thus, the description of such a component is omitted.

In this modification, a pushed portion 5*c*, which is fit into the switch exposure aperture 1 of the outside handle 2 and can be operated from the front surface side of the outside handle 2, is formed integrally with a head portion of the elastic sealing body 5. The cap member 6 including the pushbutton portion 3 is further mounted on an upper portion of the elastic sealing body 5. The cap member 6 is connected to the elastic sealing body 5 by fitting the fitting projection portions 5*b*into the connecting openings 17*a* of the cap member 6, similarly to the aforementioned embodiment.

Accordingly, in this modification, the cap member 6 can easily be detached from and mounted in the elastic sealing body 5 in a single unit state of the pushbutton switch 100. Furthermore, as illustrated in FIG. 4A, in a state in which the pushbutton switch 100 is fixed to the outside handle 2, the pushbutton switch 100 can be prevented by the stopper portion 7 of the cap member 6 from being detached from the outside handle 2.

Further, when the cap member 6 is removed simultaneously with alteration of the mounting member 10, the specification can be changed into a specification into which the pushed portion 5*c* of the elastic sealing body 5 is exposed directly to the switch exposure aperture 1, as illustrated in FIG. 4B. Consequently, the specification can be changed by using almost all of components in the modification without change. Accordingly, the flexibility can be further improved.

The mounting member 10 is formed into a shape by which the difference in height dimension of the pushbutton switch 100 between the case of using the cap member 6 and the case of not using the cap member 6 can be absorbed. As illustrated in FIG. 4A, a folding portion 10*b* for adjusting the height is provided in the mounting member 10 used in the specification in which the cap member 6 is used.

Further, in this modification, the mounting member 10 is selected according to the specification when the lower hollow portion is filled with the sealing resin. In addition, the mounting member 10 can be detachably connected to the switch case 8. In this case, the specification can be changed at the mounting of the mounting member 10 in the switch mounting apparatus 2.

Incidentally, in the foregoing description, a case, in which the outside handle 2 of an automobile is selected as the switch mounting apparatus 2, has been described. However, in addition to this, various apparatuses can be selected as the switch mounting apparatus 2. Moreover, the invention can be applied thereto.

While description has been made in connection with specific embodiments and modified examples of the present invention, it will be obvious to those skilled in the art that various changes and modification may be made therein without departing from the present invention. It is aimed, therefore, to cover in the appended claims all such changes and modifications falling within the true spirit and scope of the present invention.

DESCRIPTION OF REFERENCE NUMERALS AND SIGNS

1 switch exposure aperture
2 switch mounting apparatus
3 pushbutton portion
4 switch body,
5 elastic sealing body
5*c* pushed portion
6 cap member
7 stopper portion
8 switch case
9 fixing wing piece
10 mounting member
11 sealing resin material
100 pushbutton switch

What is claimed is:

1. A pushbutton switch mounting structure, comprising:
a switch mounting apparatus; and
a pushbutton switch,
wherein the switch mounting apparatus includes a switch exposure aperture,
wherein the pushbutton switch includes:
a pushbutton portion exposing from the switch exposure aperture;
a switch body operable by the pushbutton portion;
an elastic sealing body that covers and seals the switch body, wherein the pushbutton portion is formed in a cap member that is formed of a hard material and detachably engaged with the elastic sealing body by a projection portion of the elastic sealing body and a connecting opening in the cap member that receives the projection portion of the elastic sealing body; and
a stopper portion provided on the cap member and configured to interfere with a rear surface of the switch mounting apparatus at a peripheral area of the switch exposure aperture and to restrain the cap member from being detached from the switch mounting apparatus.

2. A pushbutton switch comprising:
a switch case;
a switch body fixed to the switch case;
an elastic sealing body that is formed of an elastic material and covers and seals the switch body;
a cap member that is formed of a hard material and is detachably mounted at a top portion of the elastic sealing body by a projection portion of the elastic sealing body and a connecting opening in the cap member that receives the projection portion of the elastic sealing body;
a pushbutton portion provided on the cap member and exposing from a switch exposure aperture on a switch mounting apparatus in a state in which the switch case is fixed to the switch mounting apparatus; and
a stopper portion provided on the cap member and configured to interfere with a rear surface of the switch mounting apparatus at a peripheral area of the switch exposure aperture and to restrain the cap member from being detached from the switch mounting apparatus, in a state in which the switch case is fixed to the switch mounting apparatus.

3. The pushbutton switch according to claim 2, further comprising:

a pushed portion formed at a head portion of the elastic sealing body, wherein the cap member is disposed on the pushed portion.

4. A pushbutton switch comprising:

a switch case;

a switch body fixed to the switch case;

an elastic sealing body that is formed of an elastic material and covers and seals the switch body;

a cap member that is formed of a hard material and is detachably mounted at a top portion of the elastic sealing body;

a pushbutton portion provided on the cap member and exposing from a switch exposure aperture on a switch mounting apparatus in a state in which the switch case is fixed to the switch mounting apparatus;

a stopper portion provided on the cap member and configured to interfere with a rear surface of the switch mounting apparatus at a peripheral area of the switch exposure aperture and to restrain the cap member from being detached from the switch mounting apparatus, in a state in which the switch case is fixed to the switch mounting apparatus; and a mounting member fixed to a bottom wall of the switch case by a sealing resin material filled in the switch case, and including a fixing wing piece projecting to a side of the mounting member.

* * * * *